US008561675B2

(12) United States Patent
Liu et al.

(10) Patent No.: US 8,561,675 B2
(45) Date of Patent: Oct. 22, 2013

(54) SPRAY TYPE HEAT-EXCHANGING UNIT

(75) Inventors: Chung-Che Liu, Hsinchu (TW); Yie-Zu Hu, Hsinchu (TW); Hsi-Tsung Cheng, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 981 days.

(21) Appl. No.: 12/637,495

(22) Filed: Dec. 14, 2009

(65) Prior Publication Data

US 2010/0107676 A1 May 6, 2010

Related U.S. Application Data

(63) Continuation-in-part of application No. 11/642,684, filed on Dec. 21, 2006, now abandoned.

(30) Foreign Application Priority Data

Dec. 29, 2005 (TW) ..... 94147101 A

(51) Int. Cl.
*F28D 5/00* (2006.01)
*A23C 3/04* (2006.01)

(52) U.S. Cl.
USPC ..... 165/115; 62/304

(58) Field of Classification Search
USPC ..... 62/304; 165/115, 118, 159, 135
See application file for complete search history.

(56) References Cited

U.S. PATENT DOCUMENTS 1,855,552 A 4/1932 Jacocks et al.
3,146,609 A 9/1964 Engalitcheff
3,434,522 A 3/1969 Laurenty
4,585,055 A 4/1986 Nakayama et al.
5,004,043 A 4/1991 Mucic et al.
5,561,987 A 10/1996 Hartfield et al.
5,799,621 A 9/1998 Gordon et al.
5,910,167 A 6/1999 Reinke et al.
6,089,312 A 7/2000 Biar et al.
6,293,112 B1 9/2001 Moeykens et al.
6,830,099 B2 12/2004 Moeykens
6,868,695 B1 * 3/2005 Dingel et al. ..... 62/515

OTHER PUBLICATIONS

Graham., "Evaporating and Distilling Apparatus", Audels Engineers and Mechanics Guide 7, 1921, p. 3178.

* cited by examiner

*Primary Examiner* — Cassey D Bauer
(74) *Attorney, Agent, or Firm* — Birch, Stewart, Kolasch & Birch, LLP

(57) ABSTRACT

A spray type heat-exchanging unit includes a main body; a distributive refrigerant spray module located in an upper part of the main body and having an extended distributor and a refrigerant spray surface; and a plurality of heat exchange tubes provided in the main body below the distributive refrigerant spray module. A liquid refrigerant is guided into the extended distributor to drip onto the refrigerant spray surface, and then uniformly sprayed onto the heat exchange tubes. Gaseous refrigerant produced by evaporation in heat exchange in the main body is recovered via a top opening of the main body, making the mechanical refrigerating apparatus more efficient than a refrigerating apparatus adopting a flooded evaporator, and minimizing the refrigerant charge amount and material cost required by the heat-exchanging unit.

8 Claims, 3 Drawing Sheets

SPRAY TYPE HEAT-EXCHANGING UNIT

This application is a Continuation-In-Part of copending application Ser. No. 11/642,684 filed on Dec. 21, 2006 under 35 U.S.C. §120 and Patent Application No. 094147101 filed in Taiwan, R.O.C. on Dec. 29, 2005 for which priority is claimed under 35 USC 119(a). The entire contents of which are hereby incorporated by reference into the present application.

FIELD OF THE INVENTION

The present invention relates to a heat-exchanging unit employed in a refrigerant evaporator used by a mechanical refrigerating apparatus, and more particularly to a spray type heat-exchanging unit.

BACKGROUND OF THE INVENTION

A mechanical refrigerating apparatus includes four major parts, namely, a compressor, an expansion device, a condenser, and an evaporator. The currently available refrigerating systems may be generally divided into three types, namely, direct expansion type, flooded type, and spray type, according to the structure of the evaporator thereof. Wherein, the flooded type and the direct expansion type refrigerating system all belong to a shell-and-tube heat exchanger. In the direct expansion type, refrigerant flows in the tube while the target fluid flows at the shell side. To prevent the liquid refrigerant in the tube from incomplete evaporation and being sucked into the compressor to result in damage of the compressor, the direct expansion type refrigerating system must to increase the superheat at the compressor inlet, which inevitably results in high power consumption of the compressor.

In the flooded type refrigerating system, the target fluid flows in the tube while the refrigerant flows at the shell side. Since the liquid refrigerant is not subject to suction by the compressor at the inlet thereof, it is possible to decrease the superheat of the refrigerant at the compressor inlet and thereby reduce the power consumption of the compressor. However, since the tube of the flooded type evaporator must be immersed in the liquid refrigerant in the shell, an increased quantity of liquid refrigerant is required to immerse the tube located in the shell. As a matter of fact, the quantity of refrigerant required in the flooded type refrigerating system is at least twice as much as that in the direct expansion type refrigerating system to largely increase the equipment cost and environmental burden.

In a spray evaporator, the refrigerant is downward sprayed to form a liquid film on the tube in the shell. As being affected by the force of gravity, pressure and other forces, the liquid film of the sprayed refrigerant moves vertically or in a direction parallel to the tube. When the refrigerant sprayed onto the tube is evaporated, it carries away heat energy of the target fluid inside the heat exchange tube to achieve the purpose of heat exchange. Since the liquid refrigerant flows more quickly on the heat exchange tube surface, it is able to evaporate from the heat exchange tube surface into gaseous refrigerant within a shortened time. In this manner, the heat exchanger may have an enhanced performance, and the cost of the heat exchange tube in the shell could be reduced by at least 25%. Meanwhile, since it is not necessary to immerse the heat exchange tube in a large quantity of liquid refrigerant, the refrigerant charge amount in the mechanical refrigerating apparatus may be reduced by more than 20%. However, many-mechanisms in the spray evaporator, such as the refrigerant distribution control mechanism, have influence on the performance of the spray evaporator. When the mechanism for spraying the refrigerant could not be effectively controlled, the sprayed refrigerant shall become uniformly distributed on the heat exchange tube to result in unnecessary waste of energy of the refrigerating apparatus. U.S. Pat. No. 6,868,695 disclosed a closed-type distributor, where the liquid and gas phase refrigerant therein has to be pressure-driven to spray out. However, the pressure-driven distributor complicates the structure and needs additional devices to pump liquid. Accordingly, a simple and convenient spray type heat-exchanging distributor is still needed

SUMMARY OF THE INVENTION

A primary object of the present invention is to provide a spray type heat-exchanging unit that enables control of uniform distribution of liquid refrigerant to effectively increase the refrigerating efficiency and reduce the material cost of the heat-exchanging unit.

To achieve the above and other objects, the spray type heat-exchanging unit of the present invention includes a main body defining a receiving space and a top opening; a distributive refrigerant spray module located in an upper part of the main body, and having an extended distributor, a liquid refrigerant inlet, one or more openings, and a refrigerant spray surface; and a plurality of heat exchange tubes provided in the main body below the distributive refrigerant spray module. Liquid refrigerant is guided into the extended distributor via the liquid refrigerant inlet to drip onto the refrigerant spray surface via apertures provided on the extended distributor, and then uniformly sprayed onto the heat exchange tubes. The liquid refrigerant sprayed onto the heat exchange tubes is evaporated into gaseous refrigerant in the process of heat exchange in the main body, and the gaseous refrigerant is recovered via the top opening of the main body.

Since the liquid refrigerant is uniformly sprayed onto the heat exchange tubes, the spray type heat-exchanging unit enables improved refrigerating efficiency and reduced refrigerant charge amount and material cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
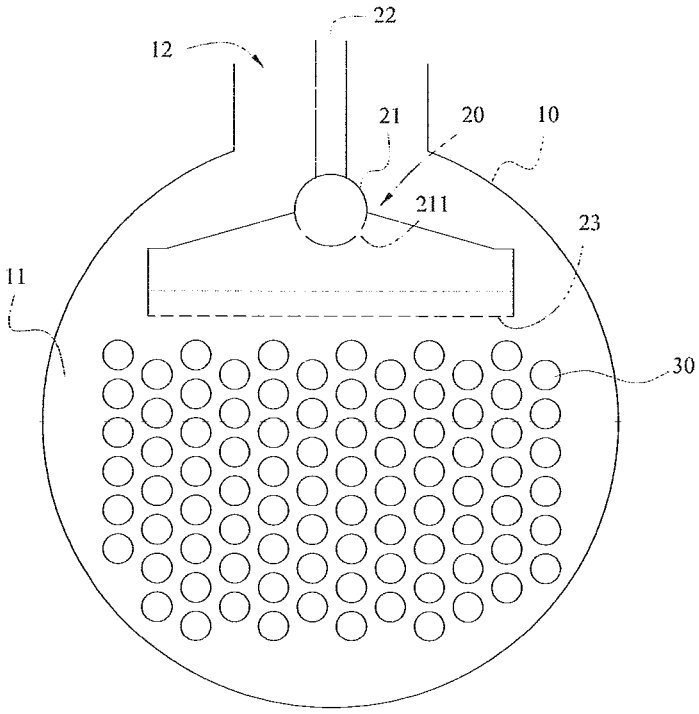
FIG. 1 is a vertical cross-section schematically showing a spray type heat-exchanging unit according to a preferred embodiment of the present invention.

Please refer to FIG. 1 that is a vertical sectional view schematically showing a spray type heat-exchanging unit according to a preferred embodiment of the present invention. As shown, the spray type heat-exchanging unit of the present invention includes a main body 10, a distributive refrigerant spray module 20, and a plurality of heat exchange tubes 30. The main body 10 has a vertical cross-section similar to a container to define an internal receiving space 11 with a top opening 12. The heat exchange tubes 30 may be staggered or in line in a lower part of the receiving space 11 in the main body 10.

Figure 2:
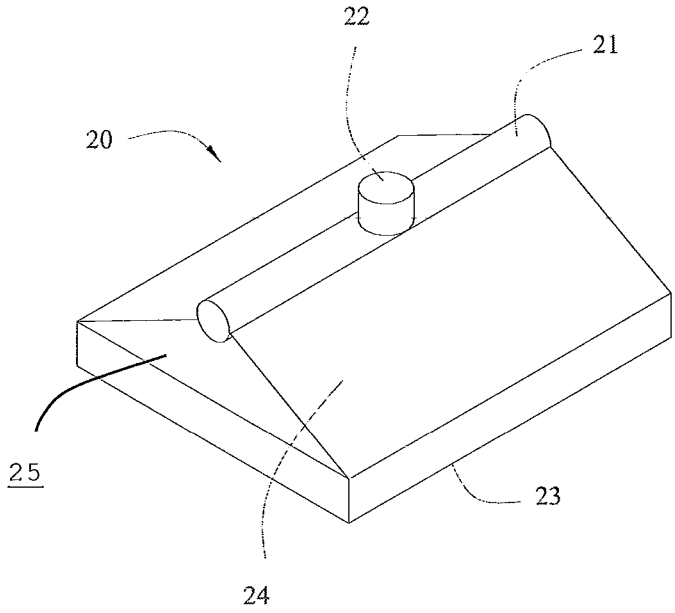
FIG. 2 is a schematic top perspective view of a distributive refrigerant spray module included in the spray type heat-exchanging unit of the present invention.

Please refer to FIGS. 1 and 2 at the same time. The distributive refrigerant spray module 20 is located in an upper part of the main body 10, and includes an extended distributor 21 having a liquid refrigerant inlet 22 centered at a top thereof and a plurality of apertures 211 formed on a bottom thereof, and a refrigerant spray surface 23 provided at a bottom of the module 20 below the extended distributor 21. It should be noted that although the exemplary extended distributor described above is an axial extended distributor, the shape of the exemplary extended distributor is not limited as a rod shape illustrated in the FIG. 2. As can be seen from FIG. 3, the refrigerant spray surface 23 includes a plurality of liquid refrigerant spray holes 231. Two splash covers 24 are extended between the extended distributor 21 and two edges of the refrigerant spray surface 23 parallel to the extended distributor 21, so as to prevent the refrigerant from splashing. One or more openings 25 are defined by the extended distributor 21, the refrigerant spray surface 23 and the splash covers 24.

Figure 3:
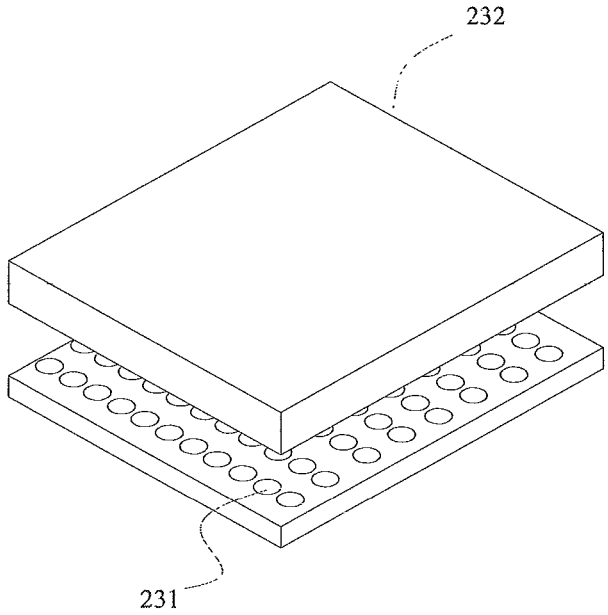
FIG. 3 shows another embodiment of the refrigerant spray surface of the distributive refrigerant spray module of the present invention.

The liquid refrigerant (not shown) is guided into the extended distributor 21 via the liquid refrigerant inlet 22 of the distributive refrigerant spray module 20. With the extended distributor 21, the liquid refrigerant is advantageously uniformly distributed along the extended distributor and drips down to the refrigerant spray surface 23 via the apertures 211 at the bottom of the extended distributor 21. The splash covers 24 prevent the dripped liquid refrigerant from splashing. In another embodiment of the refrigerant spray surface 23, a impact absorbing material 232, such as chemical fiber non-woven fabrics, plant fiber non-woven fabrics, sponges or sponge-like materials, net fabrics, metal wool, and/or non-metal wool, is provided on a top of the refrigerant spray surface 23, as shown in FIG. 3, so as to absorb the force produced by the liquid refrigerant that directly impacts against the refrigerant spray surface 23, and thereby minimizes the splashing of the liquid refrigerant and prevents the liquid refrigerant from being rapidly sprayed onto the heat exchange tubes 30 via the spray holes 231 on the refrigerant spray surface 23 to result in non-uniform spraying of the liquid refrigerant. In addition to the round holes illustrated in FIG. 3, the spray holes 231 may also be apertures, slots, or flow passages with grids, and may be of any other geometrical shapes, so long as the spray holes 231 are able to improve the uniform distribution of the liquid refrigerant on a two-dimensional surface.

Meanwhile, in one of the embodiment, about 20% of the refrigerant may be vaporized. The gaseous refrigerant (so called flash gas) can be exhausted through the openings 25. This gaseous refrigerant would not be accumulated in the distributive refrigerant spray module 20 and pressurize therein. High pressure may force the gaseous refrigerant spray into the lower part of the receiving space 11 in the main body 10 via the refrigerant spray surface 23 and obstruct the flow of the liquid refrigerant. With the opening 25, the pressure in the distributive refrigerant spray module 20 and the lower part of the receiving space 11 would be the same.

The downward sprayed liquid refrigerant forms a liquid film on the heat exchange tubes 30. As being affected by the force of gravity and other forces, the liquid film of the sprayed refrigerant moves vertically or in a direction parallel to the heat exchange tubes 30. When the refrigerant sprayed onto the heat exchange tubes 30 is evaporated, it carries away heat energy of the target fluid inside the heat exchange tubes 30 to achieve the purpose of heat exchange. Since the liquid refrigerant flows more quickly on the surfaces of the heat exchange tubes 30, it is able to evaporate from the heat exchange tube surfaces into gaseous refrigerant within a shortened time. In this manner, the heat-exchanging unit may have an enhanced performance, and the cost of the heat-exchanging unit could be reduced by at least 25%. Meanwhile, since it is not necessary to immerse the heat exchange tubes 30 in a large quantity of liquid refrigerant, the refrigerant charge amount in the mechanical refrigerating apparatus may be reduced by more than 20%.

The gaseous refrigerant produced by evaporation in the heat exchange may return to the compressor (not shown) via the top opening 12 of the main body 10. To further prevent the liquid refrigerant from entering into the compressor, a liquid separator or other types of baffles or filtering means (not shown) may be provided at the top opening 12 of the main body 10 to protect the compressor against splashed liquid particles.

To enhance the refrigerating effect, it is also possible to increase the quantity of the liquid refrigerant, but the refrigerant leftovers will accumulate in the bottom, so that a part of the heat exchange tubes 30 are immersed in the liquid refrigerant. In this manner, it is possible to effectively increase efficiency of the mechanical refrigerating apparatus, save valuable energy, and reduce the manufacturing cost of the refrigerating apparatus, making the mechanical refrigerating apparatus more efficient than the refrigerating apparatus adopting the flooded evaporator. As a result, the required refrigerant charge amount and material cost for the heat exchanger are minimized.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A spray type heat-exchanging unit, comprising:

a main body defining an internal receiving space and a top opening communicating with said receiving space;

a plurality of heat exchange tubes provided in a lower part of said receiving space of said main body; and a distributive refrigerant spray module provided in said main body above said heat exchange tubes, and including an extended distributor, a liquid refrigerant inlet, one or more openings and a refrigerant spray surface; said extended distributor being provided with a plurality of apertures, and said liquid refrigerant inlet being provided on a top of said extended distributor for guiding a liquid refrigerant into said extended distributor, so that said liquid refrigerant drips onto said refrigerant spray surface via said apertures on said extended distributor and be sprayed onto said heat exchange tubes, wherein said spray surface of said distributive refrigerant spray module is provided on a top thereof with impact absorbing material selected from a group consisting of chemical fiber non-woven fabrics, plant fiber non-woven fabrics, net fabrics, metal wool and non-metal wool, wherein said liquid refrigerant sprayed onto said heat tubes conducts heat exchange with said heat exchange tubes, and is vaporized into gaseous refrigerant, which flows out of said main body via said top opening of said main body, and wherein said one or more openings are defined by said extended distributor, said refrigerant spray surface and one or more splash covers, such that a first pressure in the distributive refrigerant spray module is the same as a second pressure in the lower part of said receiving space due to gaseous refrigerant exhausted through the one or more openings.

2. The spray type heat-exchanging unit as claimed in claim 1, wherein said spray surface of said distributive refrigerant spray module is provided with a plurality of holes.

3. The spray type heat-exchanging unit as claimed in claim 1, wherein said spray surface of said distributive refrigerant spray module is provided with a plurality of slots.

4. The spray type heat-exchanging unit as claimed in claim 1, wherein said spray surface of said distributive refrigerant spray module is provided with a plurality of flow paths with grids.

5. The spray type heat-exchanging unit as claimed in claim 1, wherein said spray surface of said distributive refrigerant spray module is provided to minimize splashing of said liquid refrigerant dripped onto said spray surface.

6. The spray type heat-exchanging unit as claimed in claim 1, further comprising covers extended between said extended distributor and said refrigerant spray surface to prevent said liquid refrigerant from splashing.

7. The spray type heat-exchanging unit as claimed in claim 1, wherein said heat exchange tubes are staggered in said receiving space of said main body.

8. The spray type heat-exchanging unit as claimed in claim 1, wherein said heat exchange tubes are orderly arranged in said receiving space of said main body.

* * * * *